United States Patent [19]

Weaver

[11] Patent Number: 4,651,701

[45] Date of Patent: Mar. 24, 1987

[54] SUBMERSIBLE FUEL PUMP AND SENDER ASSEMBLY

[75] Inventor: Frank C. Weaver, Chicago, Ill.

[73] Assignee: Steart-Warner Corp., Chicago, Ill.

[21] Appl. No.: 828,909

[22] Filed: Feb. 13, 1986

[51] Int. Cl.[4] ..... F04B 35/04

[52] U.S. Cl. ..... 123/509; 123/497; 137/590; 417/363

[58] Field of Search ..... 123/482, 497, 499, 509, 123/510; 137/565, 590, 592; 417/360, 363

[56] References Cited

U.S. PATENT DOCUMENTS

| | | | |
|---|---|---|---|
| 1,792,827 | 2/1931 | Farkas | 137/590 |
| 2,084,605 | 6/1937 | Webb | 123/497 |
| 2,963,203 | 12/1960 | Hoelle | 417/363 X |
| 3,074,347 | 1/1963 | Clymer | 417/363 |
| 4,114,783 | 9/1978 | Wempe et al. | 137/590 X |
| 4,569,637 | 2/1986 | Tuckey | 417/363 X |
| 4,590,964 | 5/1986 | Beardmore | 137/590 X |

*Primary Examiner*—Tony M. Argenbright
*Attorney, Agent, or Firm*—A. G. Douvas

[57] ABSTRACT

A submersible fuel pump and fuel sender assembly for a vehicular fuel supply system, supported within an opening in a fuel tank and located inside the tank by a plastic bumper seated in a recess in a tank wall.

14 Claims, 7 Drawing Figures

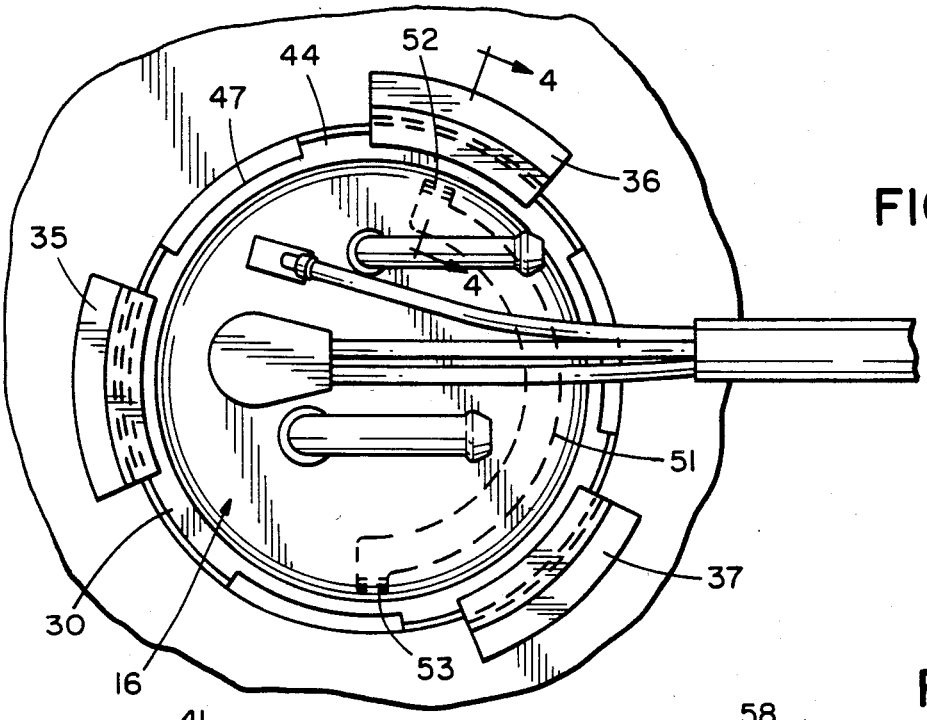
FIG.2
FIG.3
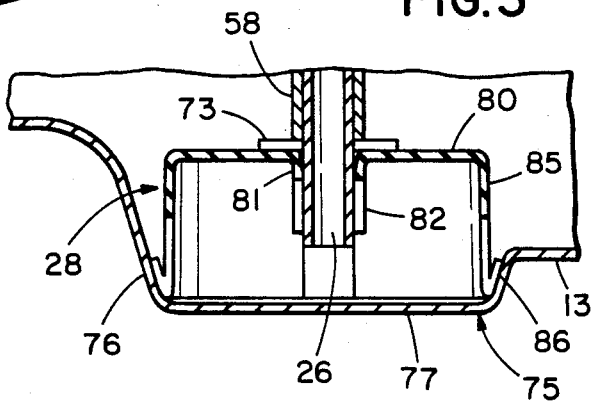
FIG.4
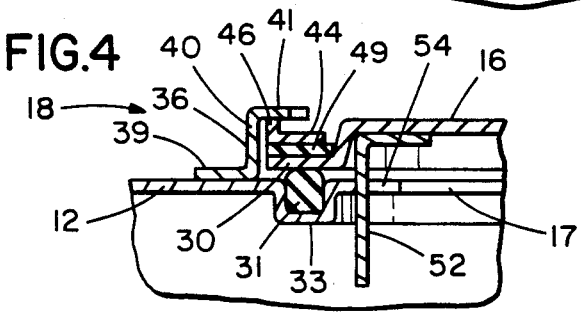
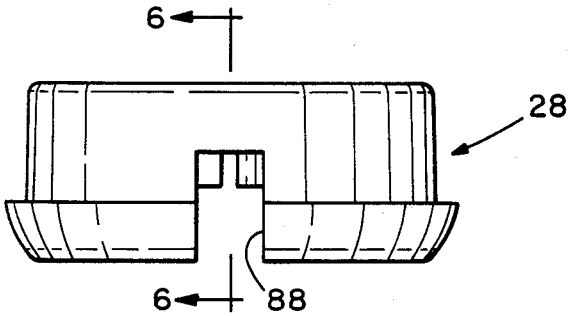
FIG.5
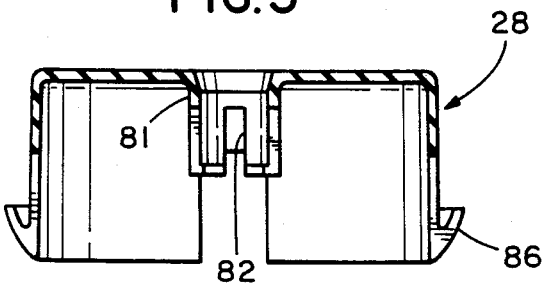
FIG.6
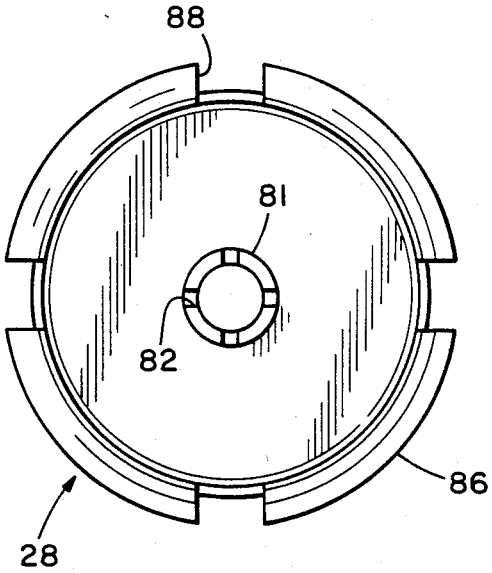
FIG.7

SUBMERSIBLE FUEL PUMP AND SENDER ASSEMBLY

BACKGROUND OF THE INVENTION

Vehicular fuel senders have been known for many decades as fuel tank mounted devices that provide a representation usually in the form of an electric signal of the quantity of fuel remaining in the tank. These representations or signals are utilized to drive fuel indicating devices commonly found in th operating compartment of the vehicle. In the past these fuel senders have commonly taken the form of a float-driven rheostat cantilevered into the tank through an opening in one of the tank walls. These fuel sender assemblies also include a rheostat supporting frame welded or soldered to a top plate covering the tank access opening along with fuel inlet and outlet tubes that are soldered to and pass through the top plate. They are quite light in weight and require no more support than a simple clamping ring that holds the supporting top plate over the access opening.

Over the last decade fuel injection systems have been increasingly popular, particularly systems in which the number of injectors is less than the number of piston and cylinder devices in the associated internal combustion engine. With the advent of these fuel injection systems it has become desirable to mount the pump directly in the fuel tank rather than in the engine compartment itself, the previously common location for fuel pumps in internal combusiton engine driven vehicles. The logical cost-effective location for these submersible pumps is on the cantilevered fuel sender assembly.

While the submersible fuel pumps are quite small, they are relatively heavy and cause vibration as they rotate imposing unusually high loadings at the junctures between the inlet and outlet tubes and the sender frame and the top plate that in some cases cause failure in one or more of these joints.

To obviate this problem it has been suggested that the combined fuel pump and fuel sender assembly be provided with a spring that reacts against the side of the fuel tank opposite the access opening mounting. One such device of this type includes a generally U-shaped leaf spring connected to the lower part of the assembly, with spring ends that engage and bias against the opposite wall of the fuel tank.

While such spring arrangements reduce pump vibration to some extent, the vibration is directional and acts mainly perpendicular to the axis of rotation of the fuel pump and the springs do not provide significant vibration limiting or absorption in this direction. Because the fuel pump is most conveniently mounted with its axis parallel to the axis of the supporting frame, the fuel pump's vibrational motion in a plane transverse to its axis even with such springs continues to result in excessive strain being imposed upon the joints at the assembly top plate.

Another problem in submersible pump assemblies is the transmission of noise from the fuel pump to the fuel tank.

It is the primary object of the present invention to ameliorate the problems noted above in supporting a fuel pump-fuel sender assembly within a fuel tank.

SUMMARY OF THE PRESENT INVENTION

According to the present invention a submersible fuel pump and sender assembly is supported within an opening in a fuel tank by a shock-absorbing clamp surrounding the opening and is located and supported inside the tank by a force-absorbing plastic bumper seated in a recess in the tank bottom wall opposite the tank opening in the top wall.

A fuel return tube according to the present invention extends almost completely across the fuel tank and has an annular plastic bumper press-fitted over its end that is axially located by a shoulder on the assembly frame. The bumper has an upwardly extending outer lip with a frusto-conical shape that fits within a complementary cup-shaped recess in the bottom wall of the tank. The plastic bumper is closely adjacent the fuel pump to absorb a major portion of the vibration loading caused by the fuel pump acting on the assembly frame so that such forces are not transmitted to the joints between the frame, the oulet and return tubing and the assembly top plate.

Another object of the present invention is to provide reduced noise transmission from the fuel pump-sender assembly to the tank itself with the provision of a shock-absorbing clamp between the assembly top plate and the fuel tank. Other objects and advantages will appear from the following detailed description of the invention.

BRIEF DESCRIPTION OF THE DRAWINGS

FIG. 2 is a top fragmentary section of the fuel tank illustrated in FIG. 1 showing the top plate of the present fuel pump-sender assembly;

FIG. 3 is an enlarged fragmentary section taken generally along 3—3 of FIG. 1 illustrating the mounting of the bumper on the lower end of the fuel return tube and the fuel tank's recess configuration;

FIG. 4 is a fragmentary section taken generally along line 4—4 of FIG. 2 illustrating the shock-absorbing clamp for the fuel pump-sender assembly top plate;

FIG. 5 is an enlarged sub-assembly of the bumper illustrated in FIGS. 1 and 3;

FIG. 6 is a longitudinal section through the bumper taken generally along line 6—6 of FIG. 5; and FIG. 7 is a bottom view of the bumper illustrated in FIGS. 5 and 6.

DETAILED DESCRIPTION OF THE PREFERRED EMBODIMENT

Figure 1:
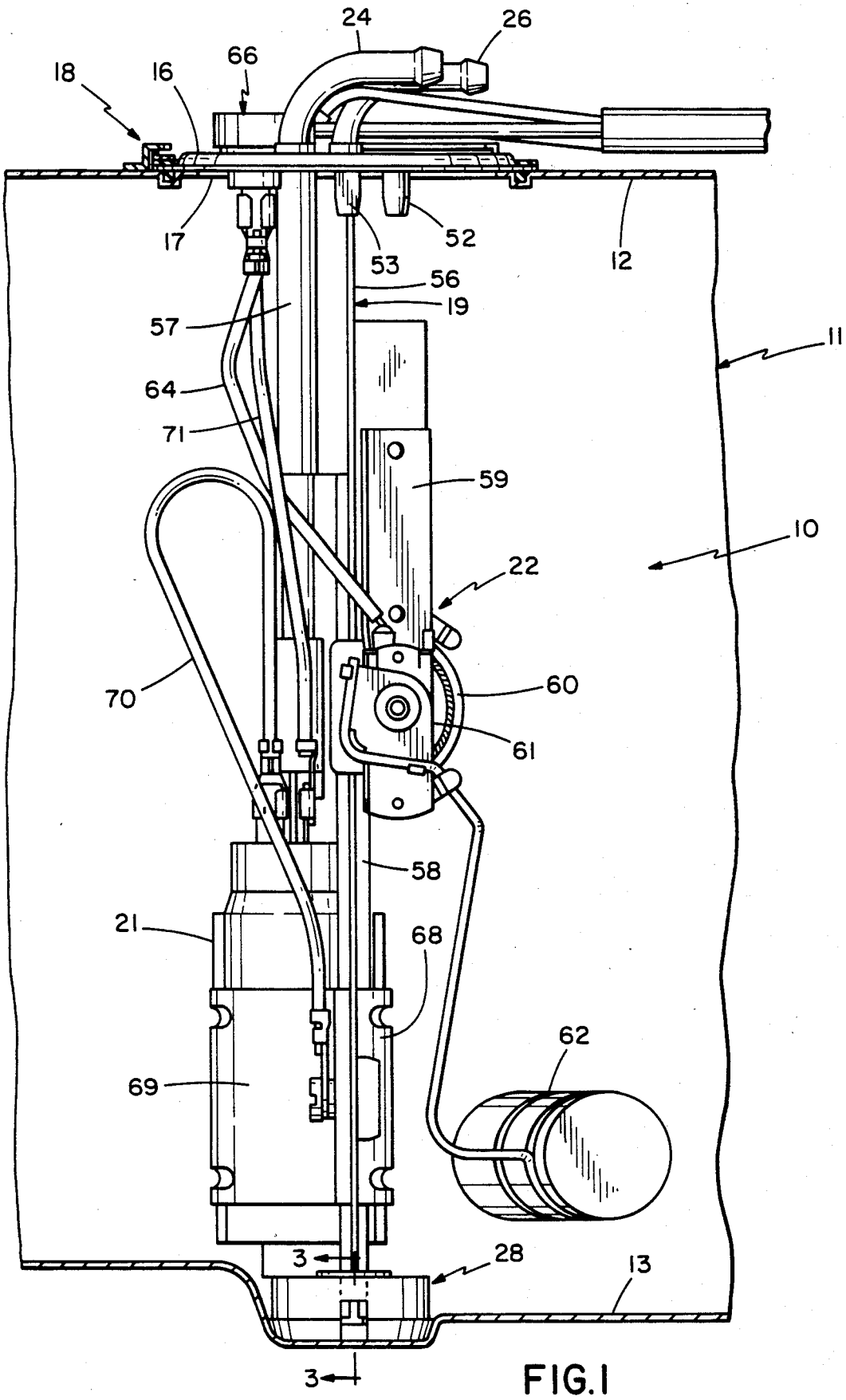
FIG. 1 is a fragmentary section of fuel tank with the present fuel pump-sender assembly mounted in position in the tank.

Referring to the drawings and particularly FIG. 1, a fuel pump-sender assembly 10 is illustrated mounted within the fuel tank 11 having a top wall 12 and a bottom wall 13. Assembly 10 is seen to generally include a circular top plate 16 clamped over an opening 17 in tank top wall 12 by a clamp assembly 18, a frame assembly 19 fixed to top plate 16, a submersible fuel pump assembly 21 supported on frame 19, a fuel sender assembly 22 also supported on frame 19, a fuel outlet tube 24 supported in top plate 16 and frame 19, a fuel return tube 26 also supported in top plate 16 and frame 19, and a bumper assembly 28 supported on the lower end of the fuel return tube 26.

Top plate 16 as seen in FIGS. 1 and 2 is circular in configuration and has an outer annular flange 30 that seats against an annular O-ring 31 mounted in a recess formed by a U-shaped annular projection 33 in tank top wall 12 surrounding opening 17 therein. O-ring 31 seals top plate 16 to the tank and also absorbs vibration from top plate 16 and in part prevents its transmission to tank 12.

The clamping assembly 18 includes three arcuate Z-shaped bracket 35, 36 and 37 welded to the top of tank 12 around opening 17 each including a base 39, a post portion 40 and a locking flange 41. An annular bayonet type locking ring 44 fits between the locking flange 41 and the flange 30 on the top plate 16 to transmit locking pressure from the flange 41 to the top plate. Ring 44 has three equally spaced cam projections 46 and three equally spaced peripheral slots 47 therebetween. Cam projections 46 are tapered vertically so that upon rotation of locking ring 44 camming portions 46 slide on the lower surfaces of locking flanges 41 increasing the downward pressure of the locking ring 44 against the top plate flange 30. Slots 47 permit the locking ring 44 during assembly or disassembly to pass over the clamping brackets 35, 36 and 37 with the locking ring 4 displaced rotationally 30 degrees from its fully locked position shown in FIG. 2.

A flat annular elastomeric member 49 is provided between locking ring 44 and the upper surface of top plate flange 30 to minimize the transmission of vibration from the fuel pump-sender assembly 10 to the tank 12 through the clamp assembly 18. This significantly reduces the noise level produced by the submersed fuel pump 21.

As seen in FIGS. 1, 2 and 4, the lower surface of the top plate has a flat arcuate locating member 51 fixed thereto that has downwardly projecting tabs 52 and 53 at its ends that fit in adjacent slots 54 extending outwardly from tank opening 17 to provide the desired angular orientation for the assembly 10 in the tank 11.

The frame 19 includes a generally L-shaped bracket 56 welded to top plate 16 having spaced arcuate portions 57 and 58 that surround and are soldered to the outlet and return tubes 24 and 26 to assist in supporting these tubes. Frame 19 also includes a V-shaped bracket 59 welded to bracket 56 that supports the fuel sender sub-assembly 22. Sender 22 includes a rheostat 60 that includes a wiper mechanism 61 driven by a float 62 that together provide an output signal in conductor 64 representing fuel level in tank 11. Conductor 64 is connected to a terminal connector 66 mounted in top plate 16.

The lower end of the arcuate frame portion 58 surrounding the return tube 26 has a large diameter arcuate projection 68 that mates with a complementary arcuate bracket 69 to clamp the fuel pump 21 in position on the frame assembly 19. Fuel pump is grounded to frame projection 68 by a ground lean 70 and is driven by positive conductor 71 connected to terminal connector 66 at top plate 16.

As seen in FIGS. 3, 5, 6 and 7, the bumper 28 is press-fitted over the lower end of the fuel return tube 26 and abuts against the lower end of the frame arcuate portion 58 through washer 73 and this arrangement limits the axial movement of the bumper 28 with respect to frame 19.

The bumper 28 is seated within a frusto-conical complementary recess 75 in lower tank wall 13 that includes a frusto-conical side wall portion 76 and a flat bottom wall portion 77.

The bumper 28 is a one-piece plastic molding and one acetyl copolymer that has been found suitable for this purpose is sold under the trademark "Celcon" product No. M27-04 manufactured by Celanese Corp. Bumper 28 preferably has a durometer midway in the Shore-B scale range and includes a flat top wall 80 having an integral central tube portion 81 with four equi-angular slots 82 therethrough that define four outwardly flexing fingers that grip and clamp on the lower end of fuel return tube 26. Note that tube 26 is spaced from the bottom of tank wall 13 as seen clearly in FIG. 3 to permit return fuel flow to the tank bottom.

Bumper 28 also includes an annular outer wall 85 ending in a backwardly extending outer lip portion 86 that is somewhat flexible to provide a tight seat against tank recess wall 76. The annular wall 85 and lip 86 have four equiangular slots 88o therethrough that permit free fuel flow into the tank 11 from return tube 26 and also provide additional radial flexing action for the segmented lip 86 to improve the tight seating of the bumper 28 in the lower tank wall recess 75. Bumper 28 reduces axial vibration of the fuel pumpsender assembly 10 because it reacts axially against the lower end of the frame 19 and reduces radial vibration because of the positive radial and shock-absorbing lock provided by the interaction between the segments of lip 86 and the recess 75 in the tank bottom wall.

I claim:

1. A vehicular fuel supply system comprising: fuel tank means having a plurality of walls, a fuel pump assembly mounted in an opening in one of the walls in the fuel tank means, said fuel pump assembly including a top plate covering said opening and a frame extending into the tank means, a submersible fuel pump supported on the frame having an outlet communicating with an outlet tube connected to and extending through the top plate, a stabilizing assembly for the pump assembly including a recess in another wall of the tank means, and a stabilizing projection reacting against the fuel pump frame and being closely fitted in the tank wall recess to positively restrict lateral movement of the fuel pump frame with respect to the top plate.

2. A vehicular fuel supply system as defined in claim 1, including a fuel return tube extending through and connected to the top plate, said fuel return tube being connected to the fuel pump frame and extending into the tank means toward said other tank wall, said stabilizing projection including a generally annular plastic bumper connected to the return tube, said recess in the tank means wall closely receiving and seating the plastic bumper.

3. A vehicular fuel supply system as defined in claim 2, wherein the bumper includes an axially forwardly extending annular wall portion and a connected rearwardly extending lip portion sized to fit in and engage the tank means wall recess.

4. A vehicular fuel supply system as defined in claim 2, wherein the recess in the tank means wall is generally frusto-conical in shape and the bumper has a complementary frusto-conical shape closely fitted in the tank wall recess.

5. A vehicular fuel supply system as defined in claim 1, including a fuel level sender mounted on the fuel assembly frame for detecting fuel level and providing an electric signal proportional to fuel level in the tank means.

6. A vehicular fuel supply system as defined in claim 5, wherein the fuel level sender includes a variable rheostat driven by a float positioned by fuel in the tank means.

7. A vehicular fuel supply system as defined in claim 1, wherein the projection is resilient.

8. A vehicular fuel supply system, comprising; a fuel tank having a plurality of walls, a fuel pump assembly mounted in an opening in one of the fuel tank walls including a top plate adapted to be mounted over the tank opening, a frame connected to the top plate extending into the tank, a submersible fuel pump mounted on the frame having an outlet communicating with an outlet tube that extends through and is connected to the top plate, an inlet tube for returning fuel to the tank extending through and connected to the top plate, said frame supporting both the outlet tube and in the inlet tube, means for supporting the fuel pump assembly in another wall of the tank including an annular recess in said other wall, and an annular plastic stop mounted on the end of the inlet tube and seated in the tank recess for preventing lateral movement of the inlet tube.

9. A vehicular fuel supply system as defined in claim 8, wherein the stop includes an annular axially forwardly extending wall and a connecting frusto-conical flexible lip portion that engages the tank wall recess, said recess having a frusto-conical complementary shape.

10. A vehicular fuel supply system as defined in claim 9, wherein the plastic stop has a plurality of radial slots therethrough.

11. A vehicular fuel supply system as defined in claim 9, wherein the plastic stop has a central sleeve receiving the end of the inlet tube, said sleeve having a plurality of radial slots therethrough so that the inlet tube may be pressed into the sleeve during assembly.

12. A vehicular fuel supply system as defined in claim 8 including a first elastomeric member between the top plate and tank to seat the top plate to the tank, clamp means for clamping the top plate against the first elastomeric member, and a second elastomeric member between the clamp means and the top plate for minimizing fuel pump vibration transmitted to the fuel tank.

13. A vehicular fuel supply system comprising: fuel tank means having a plurality of walls, a fuel pump assembly mounted in an opening in one of the walls in the fuel tank means, said fuel pump assembly including a top plate covering said opening and a frame extending into the tank means, a submersible fuel pump supported on the frame having an outlet communicating with an outlet tube connected to and extending through the top plate, a first elastomeric member between the top plate and the tank to seat the top plate to the tank, clamp means for clamping the top plate against the first elastomeric member, and a second elastomeric member between the clamp means and the top plate for minimizing fuel pump vibration transmitted to the fuel tank.

14. A vehicular fuel supply system, comprising; a fuel tank having a plurality of walls, a fuel pump assembly mounted in an opening in one of the fuel tank walls including a top plate adapted to be mounted over the tank opening, a frame connected to the top plate extending into the tank, a submersible fuel pump mounted on the frame having an outlet communicating with an outlet tube that extends through and is connected to the top plate, an inlet tube for returning fuel to the tank extending through and connected to the top plate, said frame supporting both the outlet tube and in the inlet tube, means for supporting the fuel pump assembly in another wall of the tank including an annular recess in said other wall, an annular plastic stop mounted on the end of the inlet tube and seated in the tank recess for preventing lateral movement of the inlet tube, said stop having an annular axially forwardly extending wall and a connecting frusto-conical flexible lip portion that engages the tank wall recess, said recess having a frusto-conical complementary shape, the plastic stop having a central sleeve receiving the end of the inlet tube, said sleelve having a plurality of radial slots therethrough so that the inlet tube may be pressed into the sleeve during assembly, a first elastomeric member between the top plate and the tank to seat the top plate to the tank, clamp means for clamping the top plate against the first elastomeric member, a second elastomeric member between the clamp means and the top plate for minimizing fuel pump vibration transmitted to the fuel tank, and a fuel level sender mounted on the fuel assembly frame for detecting fuel level and providing an electric signal proportional to fuel level in the tank means.

* * * * *